US008772211B2

(12) United States Patent
Kelley et al.

(10) Patent No.: US 8,772,211 B2
(45) **Date of Patent: *Jul. 8, 2014**

(54) POLYMER BLENDS USEFUL AS VISCOSITY MODIFIERS

(75) Inventors: Jack C. Kelley, Chagrin Falls, OH (US); Chor Huang, Avon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/382,317

(22) PCT Filed: Jul. 6, 2010

(86) PCT No.: PCT/US2010/041038

§ 371 (c)(1), (2), (4) Date: Mar. 13, 2012

(87) PCT Pub. No.: WO2011/005741

PCT Pub. Date: Jan. 13, 2011

(65) Prior Publication Data

US 2012/0157364 A1 Jun. 21, 2012

Related U.S. Application Data

(60) Provisional application No. 61/223,801, filed on Jul. 8, 2009.

(51) Int. Cl.

| | |
|---|---|
| ***C10M 111/04*** | (2006.01) |
| ***C10M 119/02*** | (2006.01) |
| ***C10M 107/02*** | (2006.01) |

(52) U.S. Cl.

USPC ..... 508/591; 508/118; 508/507

(58) Field of Classification Search

USPC ..... 508/591, 118, 507

See application file for complete search history.

(56) References Cited

U.S. PATENT DOCUMENTS

| | | | | |
|---|---|---|---|---|
| 4,141,847 | A | 2/1979 | Kiovsky | |
| 5,205,949 | A | 4/1993 | Nalesnik | |
| 5,302,667 | A | 4/1994 | Rhodes | |
| 2005/0153849 | A1 | 7/2005 | Mishra et al. | |
| 2009/0143261 | A1 | 6/2009 | Takeoka et al. | |
| 2009/0305923 | A1* | 12/2009 | Visger et al. | 508/296 |
| 2010/0152082 | A1* | 6/2010 | Price et al. | 508/508 |

FOREIGN PATENT DOCUMENTS

| | | |
|---|---|---|
| EP | 0344836 | 12/1989 |
| EP | 0921136 | 6/1999 |
| WO | 9813443 | 4/1998 |
| WO | 2007/121039 | 10/2007 |

OTHER PUBLICATIONS

Corresponding International Publication No. WO 2011/005741 A1 and Search Report published Jan. 13, 2011.

Written Opinion from corresponding International Application No. PCT/US2010/041038 dated Sep. 6, 2010.

* cited by examiner

*Primary Examiner* — Vishal Vasisth

(74) *Attorney, Agent, or Firm* — David M. Shold, Esq.; Michael F. Esposito, Esq.

(57) ABSTRACT

The disclosed invention relates to a composition comprising an oil of lubricating viscosity, a hydrogenated copolymer of an olefin block and vinyl aromatic block, wherein the polymer is optionally functionalized, and a star polymer. Use of the composition as a lubricating composition is disclosed.

11 Claims, No Drawings

POLYMER BLENDS USEFUL AS VISCOSITY MODIFIERS

This application is a 371 of PCT/US2010/041038, filed Jul. 6, 2010, which claims benefit of 61/223,801, filed Jul. 8, 2009.

FIELD OF INVENTION

This invention relates to compositions comprising polymer blends which are useful as viscosity modifiers. These compositions may comprise an oil of lubricating viscosity, a hydrogenated copolymer of an olefin block and vinyl aromatic block, wherein the copolymer is optionally functionalized, and a radial polymer. These compositions may be useful as lubricating compositions, for example, engine oils.

BACKGROUND

The use of polymers as viscosity modifiers (or viscosity index improvers) or dispersant viscosity modifiers in oils of lubricating viscosity is known. Typical polymer backbones include polymethacrylates, polyolefins or hydrogenated styrene-butadienes, and functional derivatives thereof. For dispersant viscosity modifiers, the backbone may be functionalized with a grafted nitrogen-containing compound.

SUMMARY

Viscosity modifiers (VMs) used in engine oils often have a strong influence on the fuel economy obtained by the engine. In general, higher molecular weight VMs tend to provide better fuel economy because the viscosity of the oil under shear tends to be less as compared to VMs with lower molecular weights. However, higher molecular weight VMs also tend to exhibit more permanent loss in viscosity as a result of polymer chain scission. The permanent loss of these VMs may be measured using the Shear Stability Index (SSI) test which measures the percentage of viscosity loss of a polymer after shearing. High SSI (e.g., 40-50 SSI) polymers tend to lose significant amounts of viscosity upon shearing. Conventional VMs such as olefin copolymers typically require a high SSI in order to consistently pass the ILSAC Sequence VIB fuel economy test. The ILSAC Sequence VIB test is a fuel economy test required for North American gasoline engine lubricants with GF-4 credentials. The test measures both initial fuel economy and fuel economy durability.

Recently, some manufacturers have indicated that there is a need for lubricants to stay in grade after substantial use in the field. This has resulted in some manufacturers requiring that the permanent shear be no greater than 35 SSI. This is in conflict with the requirement for providing good fuel economy. The problem therefore is to provide an engine oil composition containing a VM that exhibits good shear stability (i.e., 35 SSI or less) and passes the ILSAC Sequence VIB fuel economy test. This invention provides a solution to this problem.

The present invention relates to a composition, comprising: (I) an oil of lubricating viscosity; (II) a hydrogenated copolymer comprising block A and block B, block A comprising at least one olefin polymer block, block B comprising at least one vinyl aromatic polymer block, the mole ratio of block A to the combination of block A plus block B being in the range from 0.5 to 0.9; wherein from 5 to 95 mol % of the repeat units in block A contain branched alkyl groups (that is to say, alkyl branches or alkyl branching groups, such as ethyl groups), with the proviso that when the copolymer comprises a tapered copolymer, greater than 38.5 mol % to 95 mol % of the repeat units in block A contain branched (branching) alkyl groups, the branched alkyl groups of block A optionally being further substituted; and wherein the hydrogenated copolymer is optionally further functionalized by at least one of the following routes (i) block A or block B being further functionalized with a pendant carbonyl containing group, and wherein the pendant carbonyl containing group is optionally further substituted (i.e., including being reacted or condensed) to provide an ester, amine, imide or amide functionality, and/or (ii) block A being further functionalized with an amine functionality bonded directly onto the olefin polymer block; and (III) a radial polymer comprising a core and a plurality of polymeric arms extending from the core, each arm being derived from one or more conjugated dienes and one or more monoalkenyl aromatic hydrocarbons, each arm having a weight average molecular weight in the range from 40,000 to 200,000, each arm being hydrogenated at from 90 to 100% of the available double bonds (exclusive of the double bonds in the aromatic hydrocarbons), the radial polymer having a weight average molecular weight in the range from 300,000 to 2,500,000.

The weight ratio of (II) to (III) may be in the range from 90:10 to 10:90, or from 90:10 to 50:50, or from 80:20 to 70:30, or 80:20.

Component (ii), the hydrogenated copolymer, may alternatively be expressed as a hydrogenated copolymer comprising at least one of block A and at least one of block B, block A comprising an olefin polymer block, block B comprising a vinyl aromatic polymer block, the mole ratio of monomer units in block A to the monomer units in the combination of block A plus block B being in the range from 0.5 to 0.9; wherein from 5 to 95 mol % of the repeat units in block A contain alkyl branching groups, with the proviso that when the copolymer comprises a tapered copolymer greater than 38.5 mol % to 95 mol % of the repeat units in block A contain alkyl branching groups, the alkyl branching groups of block A optionally being further substituted; and wherein the hydrogenated copolymer is optionally further functionalized by at least one of the following routes (i) block A or block B being further functionalized with a pendant carbonyl containing group, and wherein the pendant carbonyl containing group is optionally further substituted to provide an ester, amine, imide or amide functionality, and/or (ii) block A being further functionalized with an amine functionality bonded directly onto the olefin polymer block.

The inventive composition may comprise a concentrate, the concentration of (II) and (III) in the concentrate being in the range from 4 to 20% by weight, or from 8 to 12% weight.

The inventive composition may comprise a fully formulated lubricating oil composition, the concentration of (II) and (III) in the lubricating oil composition being in the range from 0.5% to 2.5%, or from 0.8% to 1.5%.

The inventive composition may comprise an engine oil, wherein the composition has at least one of (i) a sulphur content of 0.8 wt % or less, (ii) a phosphorus content of 0.2 wt % or less, or (iii) a sulphated ash content of 2 wt % or less.

The inventive composition may comprise an engine oil wherein the composition has a (i) a sulphur content of 0.5 wt % or less, (ii) a phosphorus content of 0.1 wt % or less, and (iii) a sulphated ash content of 1.5 wt % or less.

The invention may relate to the use of the foregoing composition as an engine oil for a 2-stroke or a 4-stroke internal combustion engine, a gear oil, an automatic transmission oil, a hydraulic fluid, a turbine oil, a metal working fluid or a circulating oil.

The invention may relate to the use of the foregoing composition as an engine oil for a 2-stroke or a 4-stroke marine diesel internal combustion engine.

DETAILED DESCRIPTION

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "branched alkyl groups" includes branched alkyl groups that are optionally further substituted. As otherwise stated, alkyl branches on the polymer chain may or may not themselves be further branched.

It is known that some of the materials described herein may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses compositions prepared by admixing the components described herein.

Each of the documents referred to herein is incorporated herein by reference. Except in the Examples, or where otherwise explicitly indicated, all numerical quantities in this description or in the appended claims specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

(I) Oil of Lubricating Viscosity

The inventive composition comprises an oil of lubricating viscosity. The oils that may be used may include natural and synthetic oils, oil derived from hydrocracking, hydrogenation, and hydrofinishing, unrefined, refined and re-refined oils and mixtures of two or more thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

The natural oils may include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

The synthetic oils may include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils that may be used may include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

The oils of lubricating viscosity may comprise one or more oils as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group I, Group II, Group III oil or mixtures thereof.

The lubricant composition may be in the form of a concentrate and/or a fully formulated lubricant. If the polymer blend of the present invention is in the form of a concentrate (which may be combined with additional oil to form, in whole or in part, a finished lubricant), the ratio of the polymer blend to the oil of lubricating viscosity and/or to diluent oil may include the ranges of 1:99 to 99:1 by weight, or 80:20 to 10:90 by weight.

(II) Hydrogenated Copolymer

The hydrogenated copolymer may comprise block A and block B. These may be represented by the formulae:

Block (A)

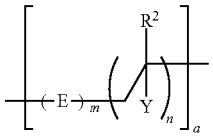

and

Block (B)

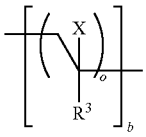

wherein a and b are coefficients for their corresponding monomer repeat units, wherein the ratio of a/(a+b) is 0.5 to 0.9, or 0.55 to 0.8, or 0.6 to 0.75;

$R^2$ is H, alkyl, or alkyl-Z, with the proviso that 5 mol % to 95 mol % of the $R^2$ groups are alkyl or alkyl-Z groups (in one embodiment, $R^2$ is not H);

$R^3$ is an arene group or an alkyl-substituted arene group optionally further functionalized with a pendant carbonyl-containing group;

E is an alkylene group or an alkenylene group (typically E is a $C_4$ group);

X, Y and Z are independently H or pendant carbonyl-containing groups, with the proviso that at least one of X, Y and Z is a pendant carbonyl-containing group; and m, n, and o are numbers of repeat units for the moieties described above, with the proviso that each repeat unit is present in sufficient quantities to provide the polymer with an appropriate number average molecular weight, and wherein the polymer is terminated with a polymerisation terminating group, and with the proviso that when the copolymer comprises a tapered copolymer block, A contains repeat units with greater than 38.5 mol % to 95 mol % of branched, optionally substituted alkyl groups (that is, alkyl branching groups).

The hydrogenated copolymer may be represented by the formula:

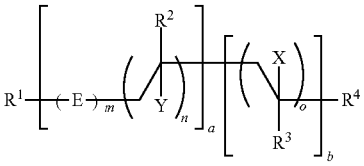

wherein a and b are coefficients for their corresponding monomer repeat units, wherein the ratio of a/(a+b) is 0.5 to 0.9, or 0.55 to 0.8, or 0.6 to 0.75;

$R^1$ is H, t-alkyl, sec-alkyl, $CH_3$—, $R'_2N$—, or aryl, or, in another embodiment, primary alkyl;

$R^2$ is H, alkyl or alkyl-Z, with the proviso that in block (A) 5 mol 5 to 95 mol % of the $R^2$ groups are alkyl or -alkyl-Z groups;

$R^3$ is an arene group or an alkyl-substituted arene group optionally further functionalized with a pendant carbonyl-containing group;

$R^4$ is a polymerising terminating group, such as H or alkyl;

E is an alkylene group or an alkenylene group (typically E is a $C_4$ group);

X, Y and Z are independently H or a carbonyl-containing group, with the proviso that at least one of X, Y and Z is a pendant carbonyl-containing group;

R' is a hydrocarbyl group, and m, n, and o are numbers of repeat units for the moieties described above, with the proviso that each repeat unit is present in sufficient quantities to provide the hydrogenated copolymer with an appropriate number average molecular weight, and with the proviso that when the copolymer comprises a tapered copolymer, block A contains repeat units with greater than 38.5 mol % to 95 mol % of branched, optionally substituted alkyl groups (that is, branching alkyl groups).

The hydrogenated copolymer may be made by the process comprising:

(a) polymerizing (i) a vinyl aromatic polymer block and (ii) an olefin polymer block, wherein the olefin reacts by 1,2-addition to give 5 mol % to 95 mol % of branched, optionally substituted alkyl groups in the olefin polymer block, followed by one or more of steps (b) to (d);

(b) optionally hydrogenating the product of step (a);

(c) optionally either (c1) reacting, under free radical grafting conditions (in processes well known to a person skilled in the art of polymer science e.g., solution phase and/or melt processes i.e. extrusion grafting), a carbonyl containing compound, with the polymer from step (b) to form a polymer with a pendant carbonyl containing group, or (c2) reacting, under thermal grafting conditions, a carbonyl containing compound with the polymer from step (a) to form a polymer with a pendant carbonyl containing group, followed by optionally hydrogenating the polymer of (c2);

(d) optionally reacting the carbonyl containing polymer of step (c1) and/or (c2) with at least one of an alcohol and/or an amine (typically forming an ester, an amide or an imide) to form a functionalized polymer, with the proviso that when the copolymer comprises a tapered copolymer, block A contains repeat units with greater than 38.5 mol % to 95 mol % of branched, optionally substituted alkyl groups (that is, alkyl branching groups); and (e) optionally reacting the copolymer with a pendant carbonyl-containing group with at least one of an alcohol and/or an amine, to form a functionalized polymer, with the proviso that when the copolymer comprises a tapered copolymer, block A contains repeat units with greater than 38.5 mol % to 95 mol % of branched, optionally substituted alkyl groups (that is, alkyl branching groups).

The hydrogenated copolymer may be hydrogenated at 50% to 100%, or 90% to 100% or 95% to 100% of available double bonds (which does not include aromatic unsaturation).

In one embodiment block A may be derived from one or more dienes. Suitable dienes used to generate the block represented by A include 1,3-butadiene or isoprene. In one embodiment the diene is 1,3-butadiene. In one embodiment block A is substantially free of, or free of, isoprene.

As used herein the term "substantially free of isoprene" means the polymer contains isoprene-derived units at not more than impurity levels, typically, less than 1 mol % of the polymer, or 0.05 mol % or less of the polymer, or 0.01 mol % or less of the polymer, or 0 mol % of the polymer.

The diene may polymerize by either 1,2-addition or 1,4-addition. The degree of 1,2-addition may be defined by the relative amounts of repeat units of branched alkyl groups (also defined herein as $R^2$). Any initially-formed pendant unsaturated or vinyl groups, upon hydrogenation, become alkyl branches ("branched alkyl groups").

Block A (when not in a tapered copolymer) may contain from 20 mol % to 80 mol %, or 25 mol % to 75 mol %, or 30 mol % to 70 mol %, or 40 mol % to 65 mol % of repeat units of branched alkyl groups.

A tapered copolymer, may contain 40 mol % to 80 mol %, or 50 mol % to 75 mol % of block A containing repeat units of branched alkyl groups (or vinyl groups).

The copolymer may be prepared by anionic polymerization techniques. As a person skilled in the art will appreciate, it is believed that anionic polymerization initiators containing alkali metals and/or organometallic compounds are sensitive to interactions between the various metals and the counterion and/or solvent. In order to prepare a polymer with increasing amounts of diene polymerized with a larger amount of 1,2-addition, it is typical to employ a polar solvent (for example tetrahydrofuran). Further employing an initiator with a lower atomic mass is suitable (for example use lithium rather than cesium). In different embodiments butyl lithium or butyl sodium may be used as initiators. Typical anionic polymerization temperatures such as below 0° C., or −20° C. or less may be employed. A more detailed description of methods suitable for preparing a polymer with a greater amounts of diene 1,2-addition stereospecificity is found in Kirk-Othmer Encyclopedia of Chemical Technology, Third Edition, Volume 4, pages 316-317 or in Anionic Polymerisation, Principles and Practical Applications, Edited by Henry L. Hsieh and Roderic P. Quirk, pages 209 and 217, 1996, Marcel Dekker.

The olefin polymer block may be formed with a large amount of 1,2-addition (i.e. 5 mol % to 95 mol % of branched groups) by employing the processes or methods described in U.S. Pat. No. 5,753,778 (discloses in column 3, lines 1 to 33 a process using an alkyllithium initiator for selectively hydrogenating a polymer); U.S. Pat. No. 5,910,566 (discloses in column 3, lines 13 to 43 a suitable process, solvent and catalyst for hydrogenating a conjugated diene); U.S. Pat. No. 5,994,477 (discloses in column 3, line 24 to column 4, line 32 a method for selectively hydrogenating a polymer); U.S. Pat. No. 6,020,439 (column 3, lines 30-52 discloses a suitable catalyst); and U.S. Pat. No. 6,040,390 (discloses in column 9, lines 2-17 a suitable catalyst). Typically the amount of 1,2-addition disclosed in the Examples of these patents range from 30 to 42% of the butadiene units).

Suitable vinyl aromatic monomers include styrene or alkylstyrene (e.g. alpha-methylstyrene, para-methyl styrene, para-tert-butylstyrene, alpha-ethylstyrene, and para-lower alkoxy styrene). In one embodiment the vinyl aromatic monomer is styrene.

The vinyl aromatic monomers (e.g. a substituted styrene) may often be functionalized with a group including acyl groups or halo-, alkoxy-, carboxy, hydroxy-, sulphonyl-, nitro-, nitroso-, and hydrocarbyl-substituents wherein the hydrocarbyl group typically has 1 to 12 carbon atoms.

The acyl group may be incorporated into the vinyl aromatic block under thermal grafting conditions, optionally in the presence of a Lewis acid. Suitable Lewis acid catalysts are known in the art and include $BF_3$ and complexes thereof, $AlCl_3$, $TiCl_4$, or $SnCl_2$. Complexes of $BF_3$ include boron trifluoride etherate, boron trifluoride-phenol and boron trifluoride-phosphoric acid.

Thermal grafting conditions are known in the art and include a reaction temperature of 0° C. to 150° C., or 10° C. to 120° C. or 50° C. to 100° C.

The pendant carbonyl-containing group may be derived from alkyl acid halides (typically chlorides), alkyl anhydrides or alkyl-substituted monocarboxylic acids or derivatives thereof. In different embodiments the alkyl group contains 6 to 100, or 8 to 80 or 8 to 50 carbon atoms. Examples of a suitable alkyl group include polyisobutylene, linear or branched dodecyl, tetradecyl or hexadecyl.

The weight average molecular weight of the hydrogenated copolymer may be in the range from 1000 to 1,000,000, or 5,000 to 500,000, or 10,000 to 250,000, or 50,000 to 175,000.

The polydispersity of the hydrogenated polymer may be in the range from 1 to less than 1.6, or 1 to 1.55, or 1 to 1.4, or 1.01 to 1.2.

The hydrogenated copolymer may comprise a backbone derived from 5 to 70 mol %, or 10 mol % to 60 mol %, or 20 mol % to 60 mol % of the alkenylarene monomer e.g., styrene.

The hydrogenated copolymer may comprise a backbone derived from 30 to 95 mol %, or 40 mol % to 90 mol %, or 40 mol % to 80 mol % of an olefin monomer, typically a diene, e.g., butadiene.

The hydrogenated copolymer is a block copolymer and may include regular, random, tapered or alternating architectures. The block copolymer may be either a di-block AB copolymer, or a tri-block ABA copolymer. Often the polymer is a di-block AB copolymer. In one embodiment the polymer is other than a tapered copolymer.

In one embodiment the pendant carbonyl-containing group is present on X or Y as disclosed by the formulae Block (A) and Block (B) defined above.

The X and Y groups may be grafted onto the polymer backbone under free radical conditions. The free radical conditions are known and include a reaction temperature of 20° C. to 200° C., or 60° C. to 160° C.

The $R^2$ group, containing alkyl or -alkyl-Z groups, may also be defined as a vinyl group prior to hydrogenation. The 1,2-addition produces a vinyl group or branching group. The number of carbons present on an unsubstituted $R^2$ may be from 1 to 8, or 1 to 4, or about 2. When $R^2$ is further substituted, e.g., with a pendant carbonyl containing group, the number of carbon atoms on $R^2$ increases by the number of carbon atoms present in the pendant carbonyl containing group.

The Z group of the -alkyl-Z and/or the Y group may be grafted onto the vinyl or branched group or backbone under ene-reaction conditions.

The ene-reaction conditions are known and include a reaction temperature of 60° C. to 220° C., or 100° C. to 200° C.

$R^3$ may be derived from vinyl aromatic monomers, or mixtures thereof. In one embodiment $R^3$ may be substituted styrene.

The hydrogenated copolymer may be a sequential block, random block or regular block copolymer. In one embodiment the hydrogenated copolymer is sequential block copolymer.

As used herein the term "sequential block copolymer" means that the copolymer consists of discrete blocks (A and B), each made up of a single monomer. Examples include of a sequential block copolymer include those with A-B or B-A-B architecture.

The hydrogenated copolymer may be a linear or a branched copolymer.

The hydrogenated copolymer may be a diblock sequential block copolymer, or a diblock normal diblock copolymer.

In one embodiment the hydrogenated copolymer is not a triblock or higher block copolymer.

In one embodiment the hydrogenated copolymer comprises a backbone derived from styrene and butadiene. Commercially available copolymers of styrene and butadiene (i.e. an unfunctionalized copolymer with X, Y and Z groups defined as hydrogen from formulae above) with 5 mol % to 95 mol % of butadiene reacted by 1,2-addition include Lubrizol®7408A.

Pendant Carbonyl-Containing Group

The pendant carbonyl-containing group may be represented by a carboxylic acid or derivatives thereof, such as an amide- or imide-containing group. The carboxylic acid or derivatives thereof includes anhydrides, acyl halides, or lower alkyl esters thereof, amides, ketones, aldehydes and imides. Mixtures of such materials can also be used. These include mono-carboxylic acids (e.g., acrylic acid and methacrylic acid) and esters, e.g., lower alkyl esters thereof, as well as dicarboxylic acids, anhydrides and esters, e.g., lower alkyl esters thereof. Examples of dicarboxylic acids, anhydrides and esters include maleic acid or anhydride, fumaric acid, or ester, such as lower alkyl, i.e., those containing no more than 7 carbon atoms on the alkyl ester group.

In one embodiment the dicarboxylic acids, anhydrides and esters may be represented by the groups of formulae:

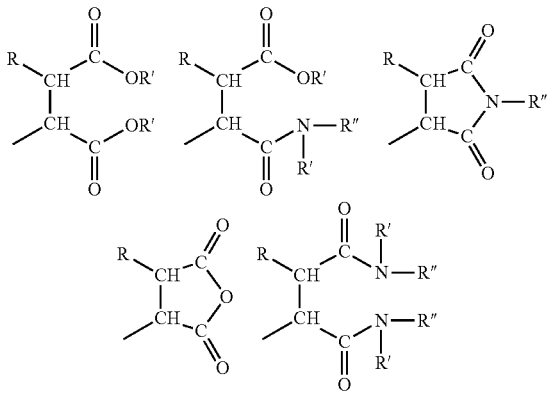

R is hydrogen or hydrocarbyl of up to 8 carbon atoms, such as alkyl, alkaryl or aryl. Each R' is independently hydrogen or hydrocarbyl, for instance, lower alkyl of up to 7 carbon atoms (e.g., methyl, ethyl, butyl or heptyl). R" may be independently aromatic (mononuclear or fused polynuclear) hydrocarbon, representative of an aromatic amine or polyamine as described below. The dicarboxylic acids, anhydrides or alkyl esters thereof typically contain up to 25 carbon atoms total, or up to 15 carbon atoms. Examples include maleic acid or anhydride, or succinimide derivatives thereof; benzyl maleic anhydride; chloro maleic anhydride; heptyl maleate; itaconic acid or anhydride; citraconic acid or anhydride; ethyl fumarate; fumaric acid; mesaconic acid; ethyl isopropyl maleate; isopropyl fumarate; hexyl methyl maleate; and phenyl maleic anhydride. Maleic anhydride, maleic acid and fumaric acid and the lower alkyl esters thereof are often used.

Alcohol-Functionalized Copolymer

In one embodiment the hydrogenated copolymer of the invention further comprises an ester group, typically from the reaction of the carbonyl-containing functional group with an alcohol. Suitable alcohols may contain 1 to 40 or 6 to 30 carbon atoms.

Examples of suitable alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

Nitrogen-Functionalized Copolymer

In one embodiment the hydrogenated copolymer of the invention further comprises a nitrogen-containing group. In one embodiment the copolymer may be further reacted/grafted with a nitrogen-containing group to form a functionalized polymer containing an amine, amide or imide group. Typically the nitrogen-containing group reacts with the pendant carbonyl-containing group. Suitable amines include aliphatic, aromatic or non-aromatic amines.

The amine functional group may be (i) bonded to a pendant carbonyl containing group, e.g., a carboxylic acid to form an imide or amide functionality, or (ii) the amine may be bonded directly onto the olefin block polymer (block A).

In different embodiments the amine functional group may be derived from a nitrogen-containing monomer, and/or an amine with a primary and/or secondary nitrogen.

Examples of suitable nitrogen-containing monomers include (meth)acrylamide or a nitrogen containing (meth) acrylate monomer (where "(meth)acrylate" or "(meth)acrylamide" represents both the acrylic or methacrylic materials). Typically the nitrogen-containing compound comprises a (meth)acrylamide or nitrogen containing (meth)acrylate monomer and may be represented by the formula:

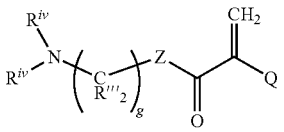

wherein

Q is hydrogen or methyl and, in one embodiment, Q is methyl;

Z is an N—H group or O (oxygen);

each R''' is independently hydrogen or a hydrocarbyl group containing 1 to 2 carbon atoms and, in one embodiment, each R''' is hydrogen;

each $R^{iv}$ is independently hydrogen or a hydrocarbyl group containing 1 to 8 or 1 to 4 carbon atoms; and g is an integer from 1 to 6 and, in one embodiment, g is 1 to 3.

Examples of suitable nitrogen-containing monomers include N,N-dimethylacrylamide, N-vinyl carbonamides (such as, N-vinyl-formamide, N-vinylacetoamide, N-vinyl-n-propionamides, N-vinyl-i-propionamides, N-vinyl hydroxyacetoamide, vinyl pyridine, N-vinyl imidazole, N-vinyl pyrrolidinone, N-vinyl caprolactam, dimethylaminoethyl acrylate, dimethylaminoethyl methacrylate, dimethylaminobutylacrylamide, dimethylamine propyl methacrylate, dimethylaminopropylacrylamide, dimethylaminopropylmethacrylamide, dimethylaminoethylacrylamide or mixtures thereof.

In one embodiment the amine is aromatic. Aromatic amines include those which can be represented by the general structure $NH_2$—Ar or T-NH—Ar, where T may be alkyl or aromatic, Ar is an aromatic group, including nitrogen-containing aromatic groups and Ar groups including any of the following structures:

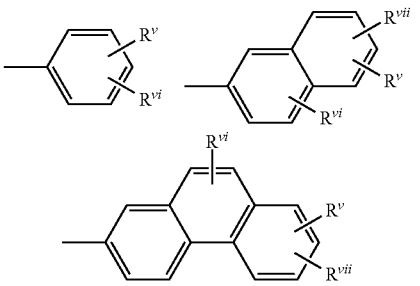

as well as multiple non-condensed or linked aromatic rings. In these and related structures, $R^{v}$, $R^{vi}$, and $R^{vii}$ can be independently, among other groups disclosed herein, —H, —$C_{1-18}$ alkyl groups, nitro groups, —NH—Ar, —N═N—Ar, —NH—CO—Ar, —OOC—Ar, —OOC—$C_{1-18}$ alkyl, —COO—$C_{1-18}$ alkyl, —OH, —O—$(CH_2CH_2—O)_nC_{1-18}$ alkyl groups, and —O—$(CH_2CH_2O)_n$Ar (where n is 0 to 10).

Aromatic amines include those amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, especially those derived from naphthalene. Examples of aromatic amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulfamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-amino-phenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole. Yet other amines include 2,5-dimethoxybenzylamine Additional aromatic amines and related compounds are disclosed in U.S. Pat. Nos. 6,107,257 and 6,107,258; some of these include aminocarbazoles, benzoimidazoles, aminoindoles, aminopyrroles, aminoindazolinones, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)-amino}butanamide.

Other aromatic amines which can be used include various aromatic amine dye intermediates containing multiple aromatic rings linked by, for example, amide structures. Examples include materials of the general structure

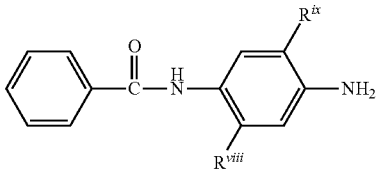

and isomeric variations thereof, where $R^{viii}$ and $R^{ix}$ are independently alkyl or alkoxy groups such as methyl, methoxy, or ethoxy. In one instance, $R^{viii}$ and $R^{ix}$ are both —$OCH_3$ and the material is known as Fast Blue RR [CAS#6268-05-9].

In another instance, $R^{ix}$ is —$OCH_3$ and $R^{viii}$ is —$CH_3$, and the material is known as Fast Violet B [99-21-8]. When both $R^{viii}$ and $R^{ix}$ are ethoxy, the material is Fast Blue BB [120-00-3]. U.S. Pat. No. 5,744,429 discloses other aromatic amine compounds, particularly aminoalkyl-phenothiazines. N-aromatic substituted acid amide compounds, such as those disclosed in U.S. Patent application 2003/0030033 A1, may also be used for the purposes of this invention. Suitable aromatic amines include those in which the amine nitrogen is a substituent on an aromatic carboxyclic compound, that is, the nitrogen is not $sp^2$ hybridized within an aromatic ring.

The aromatic amine will typically have an N—H group capable of condensing with the pendant carbonyl containing group. Certain aromatic amines are commonly used as antioxidants. Of particular importance in that regard are alkylated diphenylamines such as nonyldiphenylamine and dinonyldiphenylamine. To the extent that these materials will condense with the carboxylic functionality of the polymer chain, they are also suitable for use within the present invention. However, it is believed that the two aromatic groups attached to the amine nitrogen may lead to steric hindrance and reduced reactivity. Thus, suitable amines include those having a primary nitrogen atom (—$NH_2$) or a secondary nitrogen atom in which one of the hydrocarbyl substituents is a relatively short chain alkyl group, e.g., methyl. Among such aromatic amines are 4-phenylazoaniline, 4-aminodiphenylamine, 2-aminobenzimidazole, and N,N-dimethylphenylenediamine. Some of these and other aromatic amines may also impart antioxidant performance to the polymers, in addition to dispersancy and other properties.

In one embodiment of the invention, the amine component of the reaction product further comprises an amine having at least two N—H groups capable of condensing with the carboxylic functionality of the polymer. This material is referred to hereinafter as a "linking amine" as it can be employed to link together two of the polymers containing the carboxylic acid functionality. It has been observed that higher molecular weight materials may provide improved performance, and this is one method to increase the material's molecular weight. The linking amine can be either an aliphatic amine or an aromatic amine; if it is an aromatic amine, it is considered to be in addition to and a distinct element from the aromatic amine described above, which typically will have only one condensable or reactive NH group, in order to avoid excessive crosslinking of the polymer chains. Examples of such linking amines include ethylenediamine, phenylenediamine, and 2,4-diaminotoluene; others include propylenediamine, hexamethylenediamine, and other, ω-polymethylenediamines. The amount of reactive functionality on such a linking amine can be reduced, if desired, by reaction with less than a stoichiometric amount of a blocking material such as a hydrocarbyl-substituted succinic anhydride.

In one embodiment the amine comprises nitrogen-containing compounds capable of reacting directly with a polymer backbone. Examples of suitable amines include N-p-diphenylamine 1,2,3,6-tetrahydrophthalimide, 4-anilinophenyl methacrylamide, 4-anilinophenyl maleimide, 4-anilinophenyl itaconamide, acrylate and methacrylate esters of 4-hydroxydiphenylamine, the reaction product of p-aminodiphenylamine or p-alkylaminodiphenylamine with glycidyl methacrylate, the reaction product of p-aminodiphenylamine with isobutyraldehyde, derivatives of p-hydroxydiphenylamine; derivatives of phenothiazine, vinyl-substituted diphenylamines, or mixtures thereof.

The nitrogen-containing compound may be directly reacted onto the polymer backbone by grafting of the amine onto the polymer backbone either (i) in a solution using a solvent, or (ii) under reactive extrusion conditions in the presence or absence of solvent. The amine-functional monomer may be grafted onto the polymer backbone in multiple ways. In one embodiment, the grafting takes place by a thermal process via an "ene" reaction. In one embodiment the grafting takes place by a Friedel Crafts acylating reaction. In another embodiment the grafting is carried out in solution or solid form through a free radical initiator. Solution grafting is a well-known method for producing grafted polymers. In such a process, reagents are introduced either neat or as solutions in appropriate solvents. The desired polymer product must sometimes then be separated from the reaction solvents and/or impurities by appropriate purification steps.

In one embodiment the nitrogen-containing compound may be directly reacted onto the polymer backbone by free radical catalysed grafting of the polymer in solvents like benzene, t-butyl benzene, toluene, xylene, or hexane. The reaction may be carried out at an elevated temperature in the range of 100° C. to 250° C. or 120° C. to 230° C., or 160° C. to 200° C., e.g., above 160° C., in a solvent, such as a mineral lubricating oil solution containing, e.g., 1 to 50, or 5 to 40 wt. %, based on the initial total oil solution of said polymer and preferably under an inert environment.

The molecular weight of the functionalized polymer will be correspondingly somewhat higher than the ranges given above for the polymer. However, the weight average and number weight molecular weights for functionalized polymer may be readily estimated on the basis of the amount and molecular weight of the amine or alcohol.

Examples of commercially available hydrogenated copolymers that may be used include LZ® 7408A which is available from Lubrizol, and Dyne® 623-11, Dyne® 623-12 and Dyne® 623-14 which are available from Dynasol.

(III) Radial Polymer

The radial polymer may comprise a plurality of polymeric arms attached to a core. The radial polymer may be referred to as a star polymer. The radial polymer may be derived from one or more conjugated dienes and one or more monoalkyenyl aromatic hydrocarbon monomers. The conjugated dienes may include those dienes having from 4 to 12 carbon atoms. These may include 1,3-butadiene; isoprene; 2,3-dimethyl-1,3-butadiene; 3-butyl-1,3-octadiene; 1-phenyl-1,3-butadiene; 1,3-hexadiene; 4-ethyl-1,3-hexadiene; or a mixture of two or more thereof. The monoalkenyl aromatic hydrocarbons may include aryl-substituted olefins such as styrene, various alkyl styrenes, alkoxy-substituted styrenes, vinyl napthylene, vinyl toluene, or a mixture of two or more thereof. The radial polymer may be derived from butadiene and styrene. The molar ratio of the one or more dienes to the one or more monoalkenyl aromatic hydrocarbons in the arms of the radial polymer may be in the range from 1 to 9, or from 1.5 to 4.

The arms of the radial polymer may be polymerized using an anionic initiator. The anionic initiator may include one or more alkali metal hydrocarbon compounds, including compounds wherein lithium is the alkali metal. The lithium compounds may include alkenyl lithium compounds such as allyl lithium, methallyl lithium and the like; aromatic lithium compounds such as phenyl lithium, the xylyl lithiums, the napthyl lithiums, and the like; alkyl lithiums such as methyl lithium, ethyl lithium, propyl lithium, amyl lithium, hexyl lithium, 2-ethyl hexyl lithium; or a mixture of two or more thereof.

The arms of the radial polymer may be polymerized in a solvent. The solvent may include one or more hydrocarbons such as paraffins, cyclo-paraffins, alkyl-substituted cyclo-paraffins, aromatics and alkyl-substituted aromatics containing from 4 to 10 carbon atoms, and the like. Suitable solvents may include benzene, toluene, cyclohexane, methylcyclohexane, n-butane, n-hexane, n-heptane and the like.

The arms of the radial polymer may be coupled by reaction with a polyalkenyl coupling agent. The polyalkenyl coupling agents capable of forming the radial polymers may include compounds containing two or more non-conjugated alkenyl groups. The non-conjugated alkenyl groups may be attached to the same or different electron withdrawing groups such as an aromatic nucleus. The polyalkenyl coupling agents may be characterized as having the property that at least two of the alkenyl groups are capable of independent reaction with different polymer groups. The polyalkenyl coupling agents may be aliphatic, cyclic or aromatic. The polyalkenyl coupling agent may include one or more polyvinyl benzenes, for example, divinyl benzene. The number of arms attached to the core may be in the range from 3 to 12, or from 6 to 10, or from 7 to 9, or from 7 to 8.

Hydrogenation of the radial polymer may be accomplished using any of the techniques known in the art. In general, these techniques may involve the use of a suitable catalyst, particularly a catalyst or catalyst precursor comprising a Group VI or Group VIII metal atom. The radial polymer may be hydrogenated at from 90 to 100%, or from 98 to 100% of the available double bonds (which do not include aromatic unsaturation).

The weight average molecular weight each of the arms of the hydrogenated radial polymer may be in the range from 40,000 to 200,000, or from 60,000 to 100,000. The polydispersity of the arms may be in the range from 1.02 to 1.20, or from 1.05 to 1.10. The weight average molecular weight of the radial polymer may be in the range from 300,000 to 2,500,000, or from 500,000 to 1,000,000.

The radial polymer may comprise a core derived from divinyl benzene and from 7 to 9, or 7 to 8, arms, extending from the core. Each arm may be derived from butadiene and styrene and have a weight average molecular weight in the range from 60,000 to 100,000, and a polydispersity in the range from 1.05 to 1.10. The radial polymer may have a weight average molecular weight in the range from 400,000 to 1,000,000. Each arm of the radial polymer may comprise from 80 to 95 mol % or 90 to 95 mol % hydrogenated butadiene and from 5 to 20 mol % or 5 to 10 mol % styrene (that is, units derived from butadiene and styrene, subsequently hydrogenated). Each arm of the radial polymer may comprise hydrogenated butadiene and from 50 to 80% or 60 to 70% of the hydrogenated butadiene may have the 1,2-structure, the remaining butadiene having the 1,4-structure.

Example of commercially available radial polymers that may be used may include LZ® 5994A which is available from Lubrizol.

Polymer Blends

The hydrogenated copolymer (II) and the radial polymer (III) may be blended together using any polymer blending procedure. These polymers may be co-extruded. These polymers may be blended by dispersing them in a blend or diluent oil. The weight ratio of the copolymer (II) to the radial polymer (III) may be from 90:10 to 10:90, or from 90:10 to 50:50, or from 80:20 to 70:30, or 80:20. The SSI for the polymer blend may be in the range from 0 to 40, or from 5 to 30, or from 10 to 20, or from 12 to 18.

Other Performance Additives

The inventive composition may optionally comprise other performance additives. The other performance additives may comprise at least one of metal deactivators, conventional detergents (detergents prepared by processes known in the art), dispersants, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

Dispersants

Dispersants are often known as ashless-type or ashless dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a poly(ethyleneamine).

In one embodiment the invention further comprises at least one dispersant derived from polyisobutylene succinimide with number average molecular weight of the polyisobutylene component in the range 350 to 5000, or 500 to 3000. The polyisobutylene succinimide may be used alone or in combination with other dispersants.

In one embodiment the invention further comprises at least one dispersant derived from polyisobutylene, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, phosphorus compounds and/or metal compounds.

The dispersant may be present at 0 wt % to 20 wt %, or 0.1 wt % to 15 wt %, or 0.1 wt % to 10 wt %, or 1 wt % to 6 wt %, or 7 wt % to 12 wt % of the lubricating composition.

Detergents

The lubricant composition optionally further comprises other known neutral or overbased detergents. Suitable detergent substrates include phenates, sulphur containing phenates, sulphonates, salixarates, salicylates, carboxylic acids, phosphorus acids, mono- and/or di-thiophosphoric acids, alkyl phenols, sulphur coupled alkyl phenol compounds, or saligenins. Various overbased detergents and their methods of preparation are described in greater detail in numerous patent publications, including WO2004/096957 and references cited therein. Typical overbased detergents are prepared from alkali metals and alkali earth metals, especially calcium, magnesium and sodium.

The detergent may be present at 0 wt % to 10 wt %, or 0.1 wt % to 8 wt %, or 1 wt % to 4 wt %, or greater than 4 to 8 wt %.

Antioxidants

Antioxidant compounds are known and include for example, sulphurised olefins, diphenylamines, hindered phenols, molybdenum compounds (such as molybdenum dithiocarbamates), and mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butyl phenol, 4-propyl-2,6-di-tert-butyl phenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba; the hindered phenol ester has an alkyl tail of at least four carbons and preferably eight carbons. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 and S-600 from Asahi Denka Kogyo K. K and mixtures thereof.

Viscosity Modifiers

Although the polymers (II) and (III) of the present invention may serve as viscosity modifiers, additional viscosity modifiers of other types may also be present. Such viscosity modifiers are well known materials and include hydrogenated styrene-butadiene rubbers, ethylene-propylene copolymers, hydrogenated styrene-isoprene polymers, hydrogenated radical isoprene polymers, poly(meth)acrylates (often polyalkylmethacrylates), polyalkyl styrenes, polyolefins and esters of maleic anhydride-styrene copolymers, or mixtures thereof. Such additional viscosity modifiers may be present in ranges including 0 wt % to 15 wt %, or 0.1 wt % to 10 wt % or 1 wt % to 5 wt % of the lubricating composition.

Antiwear Agents

The lubricant composition optionally further comprises at least one other antiwear agent. The antiwear agent may be present in ranges including 0 wt % to 15 wt %, or 0.1 wt % to 10 wt % or 1 wt % to 8 wt % of the lubricating composition. Examples of suitable antiwear agents include phosphate esters, borate esters, sulphurised olefins, sulphur-containing ashless anti-wear additives and metal dihydrocarbyldithiophosphates (such as zinc dialkyldithiophosphates), thiocarbamate-containing compounds, such as thiocarbamate esters, thiocarbamate amides, thiocarbamic ethers, alkylene-coupled thiocarbamates, and bis(S-alkyldithiocarbamyl)disulphides.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butyl acrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent may be a partially esterified polyol with an aliphatic carboxylic acid, often an acid containing 12 to 24 carbon atoms, e.g., a monoester. Often the monoester of a polyol and an aliphatic carboxylic acid is in the form of a mixture with a sunflower oil or the like, which may be present in the friction modifier mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, penta-erythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Another class of ashless antiwear agents includes derivatives of hydroxyl acids, e.g. tartaric acid, citric acid, and malic acid as described in US20060079413 and WO2008147704. These derivatives include esters, amides, imides and ester-amides of aliphatic alcohols and amines. The alcohols and/or amines typically contain 8 to 30 carbon atoms and maybe branched or linear or a mixture thereof.

Antiscuffing Agents

The lubricant composition may also contain an antiscuffing agent. Antiscuffing agent compounds are believed to decrease adhesive wear are often sulphur-containing compounds. Typically the sulphur-containing compounds include organic sulphides and polysulphides, such as dibenzyldisulphide, bis-(chlorobenzyl)disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentyl phenyl phosphite; dipentyl phenyl phosphite, tridecyl phosphite, distearyl phosphite and polypropylene substituted phenol phosphite; metal thiocarbamates such as zinc dioctyldithiocarbamate and barium heptylphenol diacid; the zinc salts of a phosphorodithioic acid; amine salts of alkyl and dialkylphosphoric acids, including, for example, the amine salt of the reaction product of a dialkyldithiophosphoric acid with propylene oxide and $P_2O_5$; and mixtures thereof.

Other Additives

Other performance additives such as corrosion inhibitors include those described in paragraphs 5 to 8 of U.S. application Ser No. 05/038,319 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles, dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition. Friction modifiers may be present in ranges including 0 wt % to 10 wt % or 0.1 wt % to 8 wt % or 1 wt % to 5 wt % of the lubricating composition.

Industrial Application

The polymer blend of the invention may be suitable for any lubricant composition. The polymer blend may be employed as a viscosity modifier and/or a dispersant viscosity modifier (often referred to as a DVM).

In one embodiment the polymer blend of the invention provides at least one of acceptable viscosity modifying performance, acceptable dispersant performance, and acceptable soot and sludge handling. When the polymer blend of the invention is used in an engine oil lubricant composition, it typically further provides acceptable fuel economy performance or acceptable soot and sludge handling.

Examples of a lubricant include an engine oil for a 2-stroke or a 4-stroke internal combustion engine, a gear oil, an automatic transmission oil, a hydraulic fluid, a turbine oil, a metal working fluid or a circulating oil.

In one embodiment the internal combustion engine may be a diesel fuelled engine, a gasoline fuelled engine, a natural gas fuelled engine or a mixed gasoline/alcohol fuelled engine. In one embodiment the internal combustion engine is a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. The phosphorus content may be 0.2 wt % or less, or 0.1 wt % or less, or 0.085 wt % or less, or even 0.06 wt % or less, 0.055 wt % or less, or 0.05 wt % or less. The total sulphated ash content may be 2 wt % or less, or 1.5 wt % or less, or 1.1 wt % or less, or 1 wt % or less, or 0.8 wt % or less, or 0.5 wt % or less.

In one embodiment the lubricating composition is an engine oil, wherein the lubricating composition has a (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The polymer blend of the invention may be added to a marine diesel lubricating composition at 0.01 to 20 wt %, or 0.05 to 10 wt %, or 0.1 to 5 wt %.

Example 1

A polymer blend is prepared. This blend contains 80 parts by weight LZ® 7408A (a hydrogenated styrene-butadiene block copolymer in which the butadiene block comprises 80-90 mol % of the polymer); and 20 parts by weight LZ® 5994A (a radial polymer with a polyvinyl benzene core and arms having a weight average molecular weight (Mw) of about 70,000, the total Mw for the radial polymer being about 500,000, each arm containing a majority of repeat units derived from butadiene (hydrogenated) and a minority of repeat units derived from styrene). LZ® 7408A and LZ® 5994A are available from Lubrizol. This polymer blend has an SSI of 14.3.

Example 2

An additive concentrate having the following formulation is prepared (all values are parts by weight on an oil-free basis):

| Component | Blend (oil-free) |
|---|---|
| Overbased detergent | 0.8-1.2 |
| Ashless antioxidant(s) | 1.5-2.3 |
| PIB succinimide dispersant | 2.0-2.7 |
| ZDDP | 0.7-0.9 |
| Friction modifier(s) | 0.25-0.45 |
| Anti-foam agent | 0.001-0.003 |
| Boron additive | 0.25-0.45 |
| Molybdenum additive | 0.05-0.10 |
| Diluent Oil | 0.4-0.6 |

The above-indicated additive concentrate has the following analysis (all % being by weight):

| | |
|---|---|
| % Calcium | 0.171 |
| % Sodium | 0.049 |
| % Molybdenum | 0.014 |
| % Phosphorus | 0.076 |
| % Sulfur | 0.227 |
| % Zinc | 0.083 |
| % Sulfated Ash | 0.907 |
| Total base number (TBN) | 7.646 |

Example 3

A 5W-30 engine oil having the following formulation is prepared:

| Component | Wt % |
|---|---|
| Group III base stock | 78.20 |
| Polymer blend from Example 1 | 10.60 |
| Additive concentrate from Example 2 | 11.05 |
| LZ ® 6662A (pour point depressant available from Lubrizol) | 0.15 |

This engine oil passes the ILSAC Sequence VIB fuel economy test.

While the invention has been explained in relation to various embodiments, it is to be understood that various modifications thereof may become apparent to those skilled in the art upon reading the specification. Therefore, it is to be understood that the invention provided for herein is intended to cover such modifications as may fall within the scope of the appended claims.

The invention claimed is:

1. A composition, comprising:

(I) an oil of lubricating viscosity;

(II) a hydrogenated copolymer comprising at least one of block A and at least one of block B, block A comprising an olefin polymer block, block B comprising a vinyl aromatic polymer block, the mole ratio of monomer units in block A to monomer units in the combination of block A plus block B being in the range from 0.5 to 0.9; wherein from 40 to 75 mol % of the repeat units in block A contain alkyl branching groups, wherein the hydrogenated copolymer is not functionalized; and (III) a radial polymer comprising a core and from 3 to 12 polymeric arms extending from the core, each arm being derived from one or more conjugated dienes and one or more monoalkenyl aromatic hydrocarbons, each arm having a weight average molecular weight in the range from 40,000 to 200,000, each arm being hydrogenated at from 90 to 100% of the available double bonds, the radial polymer having a weight average molecular weight in the range from 300,000 to 2,500,000;

wherein the composition is an engine oil, and wherein the composition has (a) a sulphur content of 0.5 wt % or less, (b) a phosphorus content of 0.1 wt % or less, and (c) a sulphated ash content of 1.5 wt % or less.

2. The composition of claim 1 wherein the weight ratio of (II) to (III) is in the range from 90:10 to 10:90.

3. The composition of claim 1 wherein (II) and (III) are co-extruded to produce an extrudate, the extrudate being added to the oil of lubricating viscosity.

4. The composition of claim 1 wherein the composition comprises a lubricating oil composition, the concentration of (II) and (III) in the lubricating oil composition being in the range from 0.5% to 2.0%.

5. The composition of claim 1, wherein the copolymer (II) comprises repeat units derived from butadiene and repeat units derived from an alkylenearene.

6. The composition of claim 1, wherein the copolymer comprises a backbone comprising repeat units derived from styrene and butadiene.

7. The composition of claim 1, wherein the copolymer has a number average molecular weight in the range from 1000 to 1,000,000.

8. The composition of claim 1 wherein the copolymer comprises repeat units derived from styrene and butadiene, wherein from 15 to 35 mol % of the repeat units are derived from styrene, and wherein from 90 to 100% of the double bonds available for hydrogenation are hydrogenated.

9. The composition of claim 1 wherein block A of the hydrogenated copolymer (II) is substantially free of isoprene.

10. The composition of claim 1 wherein the radial polymer (III) comprises 7 to 9 polymeric arms.

11. The composition of claim 1 wherein the copolymer (II) comprises a backbone comprising repeat units derived from styrene and butadiene and is substantially free of isoprene; wherein the radial polymer (III) comprises 7 to 9 polymeric arms; and wherein the weight ratio of (II) to (III) is in the range from 90:10 to 10:90.

* * * * *